US005851240A

United States Patent [19]

Känzig et al.

[11] Patent Number: 5,851,240

[45] Date of Patent: Dec. 22, 1998

[54] PROCESS FOR DYEING CELLULOSIC TEXTILE FIBRE MATERIALS

[75] Inventors: Alex Känzig, Therwil, Switzerland; Katharina Fritzsche, Weil am Rhein, Germany; Peter Scheibli, Bottmingen, Switzerland

[73] Assignee: Ciba Specialty Chemicals Corporation, Tarrytown, N.Y.

[21] Appl. No.: 860,761

[22] PCT Filed: Dec. 29, 1995

[86] PCT No.: PCT/EP95/05151

§ 371 Date: Jun. 11, 1997

§ 102(e) Date: Jun. 11, 1997

[87] PCT Pub. No.: WO96/21767

PCT Pub. Date: Jul. 18, 1996

[30] Foreign Application Priority Data

Jan. 12, 1995 [CH] Switzerland ..... 92/95

[51] Int. Cl.[6] ..... D06P 1/66; D06P 1/56; D06P 3/66

[52] U.S. Cl. ..... 8/541; 8/543; 8/566; 8/585; 8/597; 8/602; 8/606; 8/620; 8/629

[58] Field of Search ..... 8/541, 543–549, 8/606, 566, 585, 597, 602, 620, 629

[56] References Cited

U.S. PATENT DOCUMENTS

| | | | |
|---|---|---|---|
| 4,290,767 | 9/1981 | Abel | 8/496 |
| 4,629,470 | 12/1986 | Harper, Jr. | 8/585 |

FOREIGN PATENT DOCUMENTS

| | | |
|---|---|---|
| 1200679 | 12/1959 | France . |
| 2437461 | 4/1980 | France . |
| 1232546 | 1/1967 | Germany . |
| 846505 | 8/1960 | United Kingdom . |
| 2098620 | 11/1982 | United Kingdom . |
| 8802043 | 3/1988 | WIPO . |

OTHER PUBLICATIONS

American Dyestuff Reporter, Jul. 1989, vol. 78, No. 7, pp. 42, 45–47 & 52.

Textilhilfsmittel Katalog 1991, Konradin Verlag R. Kohlhammer, Leinfelden Echterdingen, pp. 163–170, 174–176.

*Primary Examiner*—Margaret Einsmann

*Attorney, Agent, or Firm*—David R. Crichton

[57] ABSTRACT

The invention relates to a process for dyeing and finishing cellulosic textile fiber material in one step, which comprises applying to said textile fiber material a liquor comprising (A) at least one dye, (B) a crosslinking agent, (C) a crosslinking catalyst, and (D) choline and subsequently fixing the dye on the textile fiber material.

8 Claims, No Drawings

PROCESS FOR DYEING CELLULOSIC TEXTILE FIBRE MATERIALS

The present invention relates to a process for simultaneously dyeing and finishing cellulosic textile fibre material by a pad dyeing process.

It has long been known to finish cellulosic textile fibre materials after dyeing in a separate step with specific finishers, typically agents for improving creasing and shrinkage, additives for an anti-crease and anti-shrink finish, hydrophobic agents, or flame retardants. Furthermore, attempts have also been made to carry out the dyeing and finishing of the textile material simultaneously in one step, but no satisfactory results have been obtained so far.

Surprisingly, it has now been found that cellulosic textile fibre materials can be conveniently dyed in one step and given a wash-and-wear, or anti-crease, finish if choline is added to the dye liquor. The dyeings so obtained are distinguished in particular by their excellent tinctorial strength.

Accordingly, the invention relates to a process for dyeing and finishing cellulosic textile fibre material in one step, which process comprises applying to said textile fibre material a liquor comprising (A) at least one dye, (B) a crosslinking agent, (C) a crosslinking catalyst, and (D) choline and subsequently fixing the dye on the textile fibre material.

The dyes in the dyeing liquor are reactive dyes, direct dyes or acid dyes conventionally used for dyeing cellulosic materials, typically those described in Colour Index, 3rd edition, 1971 as well as in the supplements under the sections "Reactive Dyes", "Acid Dyes" or "Direct Dyes". Illustrative examples of these dyes are sulfo group-containing monoazo, disazo, polyazo, metal complexazo, anthraquinone, phthalocyanine, formazane or dioxazine dyes.

It is preferred to use direct, acid or reactive dyes of the monoazo, disazo, polyazo, metal complexazo, anthraquinone, phthalocyanine, formazane or dioxazine series.

A particularly preferred group of dyes are the reactive dyes. These are dyes of different classes, typically of the monoazo or polyazo, metal complexazo, anthraquinone, phthalocyanine, formazane or dioxazine series, which contain at least one reactive group.

Reactive groups will be understood as meaning fibre-reactive radicals that are able to react with the hydroxy groups of cellulose, with the amino, carboxyl, hydroxyl and thiol groups of wool and silk, or with the amino and, where present, the carboxyl group of synthetic polyamides, to form covalent chemical bonds. The reactive groups are usually bonded direct or through a bridge member to the dye radical. Suitable reactive groups are typically those that contain at least one removable substituent at an aliphatic, aromatic or heterocyclic radical or wherein the cited radicals contain a radical suitable for reaction with the fibre material, typically a halotriazinyl radical, halopyrimidinyl radical or vinyl radical.

Preferred aliphatic reactive groups are those of formulae —$SO_2Y$, —$SO_2$—NH—Y, —NH—CO—alk—$SO_2Y$, —CO—NH—alk—$SO_2Y$, or —NH—CO—$Y_1$, wherein Y is a leaving group, typically β-sufatoethyl, β-thiosulfatoethyl, β-phosphatoethyl, β-acetyloxyethyl, β-haloethyl or vinyl, $Y_1$ is typically a α,β-dihaloethyl or α-haloethenyl radical, alk is $C_2$–$C_4$alkylene, and halogen is preferably chloro or bromo.

Preferred heterocyclic fibre-reactive radicals are 1,3,5-triazine radicals of formula

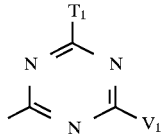

(2)

wherein $T_1$ is fluoro, chloro or carboxypyridinium, and substituents $V_1$ at the triazine ring are in particular: fluoro or chloro; —$NH_2$, unsubstituted or substituted alkylamino groups or N,N-dialkylamino groups, for example unsubstituted or hydroxy-, sulfo- or sulfato-substituted N-mono- or N,N-di$C_1$–$C_4$alkylamino; cycloalkylamino; aralkylamino, typically benzylamino; arylamino groups such as unsubstituted or sulfo-, methyl-, methoxy- or chloro-substituted phenylamino; mixed substituted amino groups such as N-alkyl-N-cyclohexylamino groups or N-alkyl-N-phenylamino groups; morpholino; as well as fibre-reactive radicals of formula

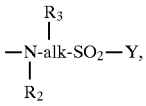

(3a)

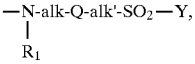

(3b)

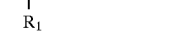

(3c)

(3d)

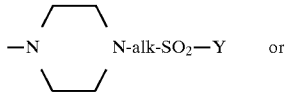

(3e)

(3f)

$R_1$ is hydrogen or $C_1$–$C_4$alkyl, $R_2$ is hydrogen, $C_1$–$C_4$alkyl which is unsubstituted or substituted by hydroxy, sulfo, sulfato, carboxy, halogen or cyano, or a radical

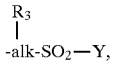

$R_3$ is hydrogen, hydroxy, sulfo, sulfato, carboxy, cyano, halogen, or the —$SO_2$—Y group, alk and alk' are each independently of the other $C_1$–$C_6$alkylene, arylene is a phenylene or naphthylene radical, each of which is unsubstituted or substituted by sulfo, carboxy, $C_1$–$C_4$alkyl, $C_1$–$C_4$alkoxy or halogen, Q is a —O— or —NRI— radical, wherein $R_1$ has the meaning given above, W is a —$SO_2$—$NR_2$—, —$CONR_2$— or —$NR_2CO$— group, wherein each $R_2$ has the meaning given above, m is 0 or 1, and Y and $Y_1$ each independently of the other have the meaning given above.

It is also possible to use dyes containing two or more identical or different reactive groups. The amount of dye in the dye liquor can vary within wide limits depending on the desired tinctorial strength and is typically from 5 to 100 g/l, preferably from 10 to 70 g/l and, most preferably, from 10 to 50 g/l, of dye liquor.

It is preferred to use dyes having medium to high fibre affinity. The dye liquors used according to this invention may contain one or also more than one dye.

Crosslinking agents (B) in the process of this invention are suitably all those agents conventionally used for improving creasing and shrinkage, typically those known from Textilhilfsmittelkatalog 1991, Konradin Verlag R. Kohlhammer, Leinfelden-Echterdingen 1991.

Suitable crosslinking agents (B) are, for example, glyoxal urea derivatives, typically the compound of formula

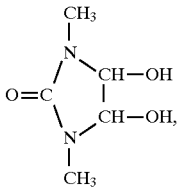

or, preferably, N-methylol derivatives of nitrogen-containing compounds, e.g. melamine/formaldehyde condensates or N-methylol urea compounds, each of which may be partially or completely etherified. The melamine/formaldehyde condensates which may be partially or completely etherified can be, for example, those of formula

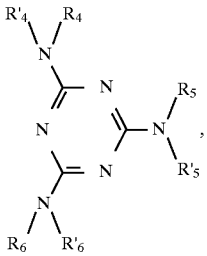

(4)

wherein $R_4$, $R'_4$, $R_5$, $R'_5$, $R_6$ and $R'_6$ are each independently of one another hydrogen, $—CH_2—OH$ or $—CH_2—OCH_3$, with the proviso that at least one of $R_4$, $R'_4$, $R'_5$, $R_6$ and $R'_6$ has a meaning other than hydrogen.

Typical examples of such melamine/formaldehyde condensates are the compounds of formula

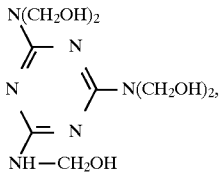

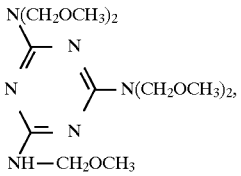

-continued

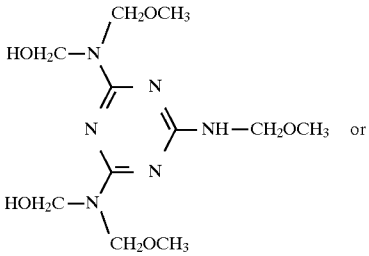

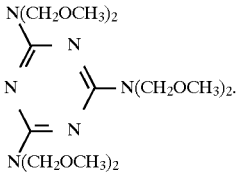

The N-methylol urea compounds which may be partially or completely etherified are typically reaction products of formaldehyde with urea or urea derivates, which reaction products may be subsequently etherified, and the urea derivatives may suitably be cyclic ethylene or propylene ureas, which can also contain substituents in the alkylene group, typically hydroxyl groups, or may be urones or unsubstituted or substitued triazone resins.

Illustrative examples of corresponding N-methylol urea compounds are unmodified or modified N-methylolhydroxyethylene urea products, typically the compounds of formula

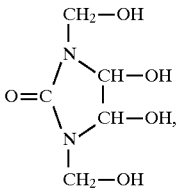

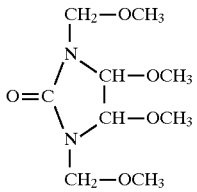

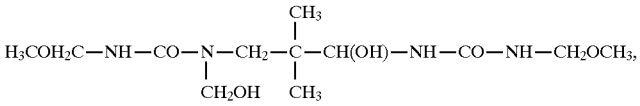

or methylolation products based on propylene urea or ethylene urea/melamine.

Preferred crosslinking agents (B) are unmodified or modified N-methylolhydroxyethylene urea compounds, methylolation products based on propylene urea or ethylene urea/melamine and, most preferably, partially or completely etherified melamine/formaldehyde condensates. It is also possible to use mixtures of two or more different crosslinking agents (B), typically a mixture consisting of one melamine/formaldehyde condensate which is completely etherified and another which is only partially etherified.

Component (B) is preferably present in the dye liquor in an amount of 10 to 200 g/l, preferably 30 to 150 g/l and, most preferably, 50 to 150 g/l, of dye liquor.

Crosslinking catalysts (C) suitable for the process of this invention are typically all those agents conventionally used as catalysts for anticrease and antishrink finishing, such as those known from Textilhilfsmittelkatalog 1991, Konradin Verlag R. Kohlhammer, Leinfelden-Echterdingen 1991. Typical examples of suitable crosslinking catalysts (C) are inorganic acids, typically phosphoric acid; Lewis acids, e.g. zinc chloride ($ZnCl_2$), zirconoxychloride, $NaBF_4$, $AlCl_3$, $MgCl_2$; ammonium salts, typically ammonium sulfate, ammonium chloride ($NH_4Cl$); or hydrohalides, preferably hydrochlorides, of organic amines, e.g. $CH_3—CH_2—CH_2—NH—CH_3$ .HCl.

Preferred crosslinking catalysts (C) in the process of this invention are ammonium salts or magnesium-containing Lewis acids and, particularly preferably, ammonium chloride or magnesium chloride.

Component (C) is preferably present in the dye liquor in an amount of 0.1 to 20 g/l, more particularly 0.5 to 15 g/l and, most preferably, 1 to 10 g/l, of dye liquor.

The choline used as component (D) is of formula

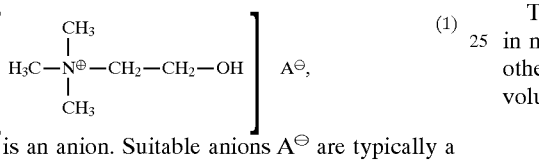

(1)

wherein $A^{\ominus}$ is an anion. Suitable anions $A^{\ominus}$ are typically a halide, sulfate, $C_1$–$C_2$alkylsulfate, thiosulfate, sulfonate, phosphate, acetate, tartrate or carboxylate anion. The variable $A^{\ominus}$ is preferably the chloride, sulfate, methylsulfate or phosphate anion and, most preferably, the chloride anion.

The component (D) is typically added to the dye liquor in an amount of 5 to 200 g/l, preferably 30 to 150 g/l and, most preferably, 50 to 120 g/l, of dye liquor.

Among the meanings given above for the variables, halogen will be understood to be typically fluoro, chloro, bromo or iodo, preferably chloro. A $C_1$–$C_4$alkyl radical is typically methyl, ethyl, n-propyl or isopropyl or n-, iso-, sec- or tert-butyl. $C_1$–$C_6$Alkylene is typically methylene, 1,1- or 1,2-ethylene, or straight-chain or branched propylene, butylene, pentylene or hexylene.

In addition to the components (A), (B), (C) and (D), the dye liquor may contain further conventional auxiliaries, typically thickeners such as commercially available alginate thickeners, starch ether, or carob bean gum ether, migration inhibitors, typically polyacrylic acid derivatives or polyacrylamide derivatides, fabric softeners, e.g. a polyethylene emulsion, as well as egalisers, wetting agents, salts, or buffer substances.

The liquor is applied to the textile fibre material by conventional methods of pad dyeing. The dye liquor is typically applied at room temperature or at moderately elevated temperature, typically in the temperature range from 15° to 40° C. The textile fibre material impregnated on the pad can then be subjected to intermediary drying.

The dye is preferably fixed on the textile fibre material by heat-treatment, typically by high-temperature steaming or dry heat steaming, typically carried out in the temperature range from 100° to 230° C. and, preferably, from 110° to 175° C. The fixing times are usefully in the range from 20 seconds to 15 minutes and, preferably, from 30 seconds to 10 minutes.

The dyed and fixed material often has such a high degree of fastness that all rinsing or washing can be dispensed with. In certain cases, however, it may be advisable to rinse the dyed material after the dyeing process in conventional manner with water or to subject it to a washing process which typically consists of treating the substrate at a temperature from 40° C. to the boiling range in a solution containing soap or a synthetic washing agent.

Cellulosic fibre materials are suitably those consisting completely or partially of cellulose. Typical examples of such materials are natural fibre materials, e.g. cotton, linen or hemp, and regenerated fibre materials, e.g. viscose, polynosic or cuprammonium silk, or cellulosic blended fibres, such as cotton/polyester materials. Wovens, knit fabrics or webs of these fibres are mainly used.

The dyeings obtained in accordance with the novel process on cellulosic fibre materials have good allround fastness properties. They typically have excellent dye-fibre bond stability both in the acid and in alkaline medium, and they also have good fastness to light as well as good wetfastness properties, such as fastness to washing, water, sea-water, cross-dyeing and perspiration, good fastness to chlorine, rubbing, ironing and pleating, and they are particularly distinguished by excellent tinctorial strength.

The following Examples serve to illustrate the invention in more detail. Parts and percentages are by weight, unless otherwise stated. The ratio of parts by weight to parts by volume is the same as that of kilograms to litres.

EXAMPLE 1

A cotton satin fabric is impregnated on a pad to a pinch-off effect of c. 70% liquor pick-up with a padding liquor of the following composition:

30 g/l of the dye of formula

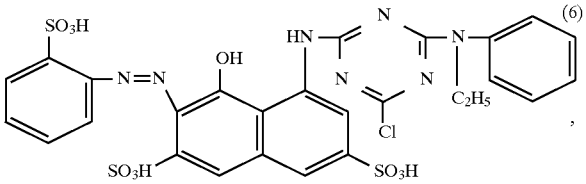

(6)

55 g/l of melamine/resin mixture containing the compounds of formula

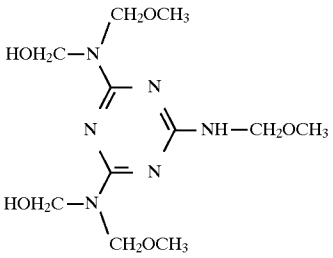

(60% aqueous solution),

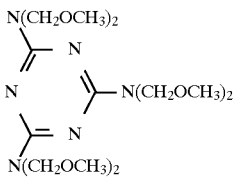

in the ratio of 1:3, 100 g/l of choline (compound of formula $[H_3C-N^{\oplus}(CH_3)_2-CH_2-CH_2-OH]\ Cl^{\ominus}$), 30 g/l of polyethylene emulsion (fabric softener, e.g. Turpex® ACN), 0.8 g/l of acetic acid, 2 g/l of ammonium chloride.

The padded fabric is dried for c. 2 minutes at 130° C. and then thermofixed for c. 5 minutes at 155° C. The dyeing so obtained is rinsed cold and hot, soaped twice at the boil with 2 g/l of $Na_2CO_3$ and 2 g/l of a nonionic surfactant, and then rinsed and dried, to give a red dyeing of very good tinctorial strength and having good allround fastness properties.

Comparison Example 1

The general procedure of Example 1 is repeated, but using a padding liquor which does not contain choline, to give a dyeing of only very weak tinctorial strength.

EXAMPLES 2–5

The general procedure of Example 1 is repeated, using padding liquors of the following composition:

| Example No.<br>Component\Amount | 2<br>g/l | 3<br>g/l | 4<br>g/l | 5<br>g/l |
|---|---|---|---|---|
| Dye | 30 | 30 | 30 | 30 |
| Melamine/resin mixture | 70 | 70 | 120 | 120 |
| Choline | 70 | 100 | 70 | 100 |
| Fabric softener | 30 | 30 | 30 | 30 |
| Acetic acid | 0.8 | 0.8 | 0.8 | 0.8 |
| Ammonium chloride | 2.5 | 2.5 | 4.0 | 4.0 |

Red dyeings of very good tinctorial strength and good allround fastness properties are obtained in each case.

Comparison Example 2

The general procedure of Examples 2 to 5 is repeated, but using in each case a padding liquor which does not contain choline, to give in each case dyeings of only very weak tinctorial strength.

EXAMPLES 6–13

The general procedure of Example 2 is repeated, but replacing 30 g/l of the dye of formula (6) with the following dyes in the amounts indicated in the Table, to give dyeings of likewise very good tinctorial strength and having good allround fastness properties.

TABLE

| Example No. | Amount g/l | Dye | Shade |
|---|---|---|---|
| 6 | 18 | 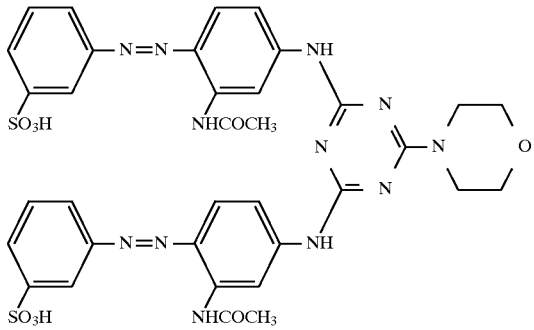 | yellow |
| 7 | 35 | 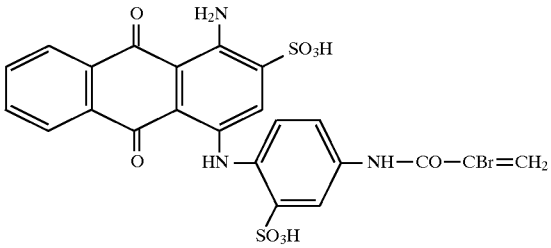 | blue |

TABLE-continued
| Example No. | Amount g/l | Dye | Shade |
|---|---|---|---|
| 8 | 25 | 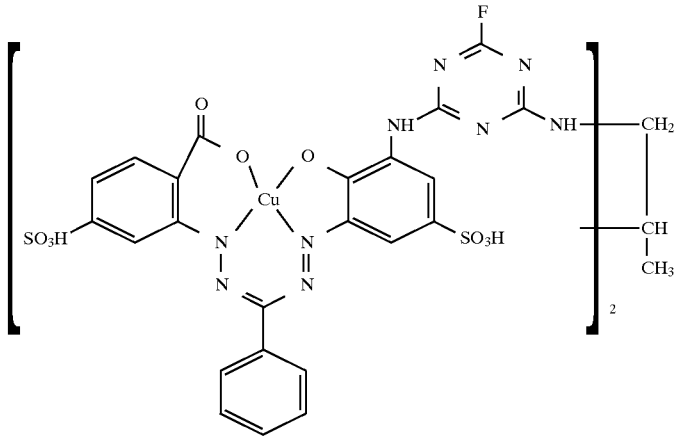 | blue |
| 9 | 24 | 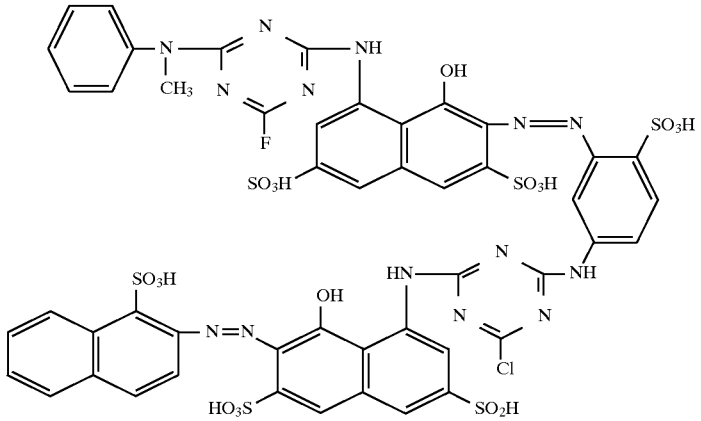 | red |
| 10 | 18 | 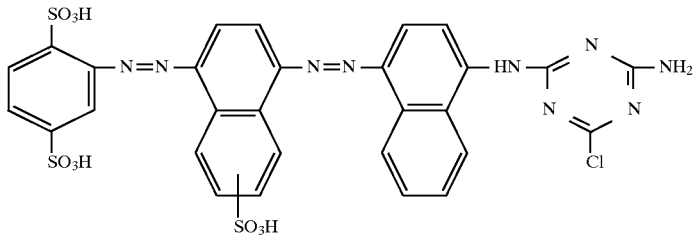 | brown |
| 11 | 48 | 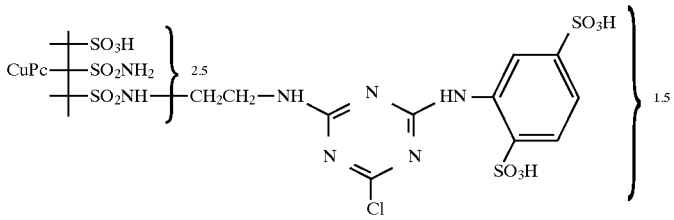 | blue |

TABLE-continued
| Example No. | Amount g/l | Dye | Shade |
|---|---|---|---|
| 12 | 42 | 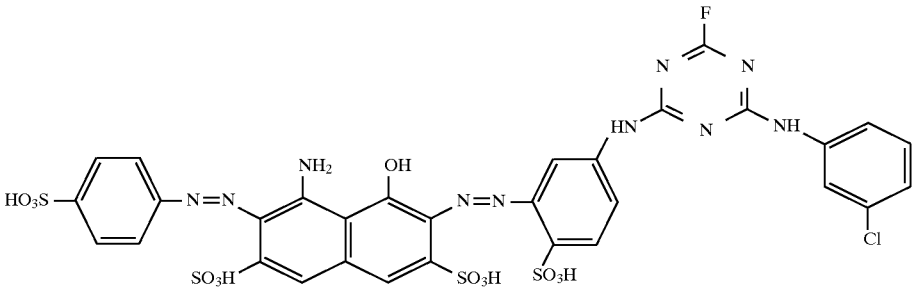 | navy blue |
| 13 | 34 | 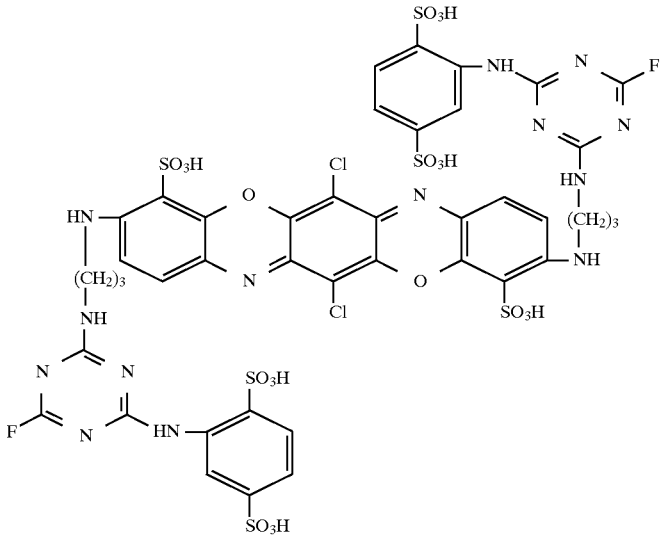 | blue (7) |
EXAMPLE 14
A cotton satin fabric is impregnated on a pad to a pinch-off effect of c. 70% liquor pick-up with a padding liquor of the following composition:
5 g/l of the dye of formula
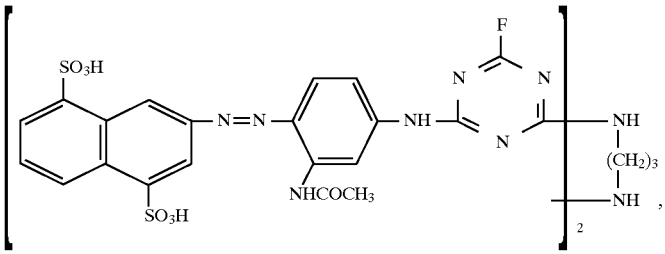
(8)
4 g/l of the dye of formula

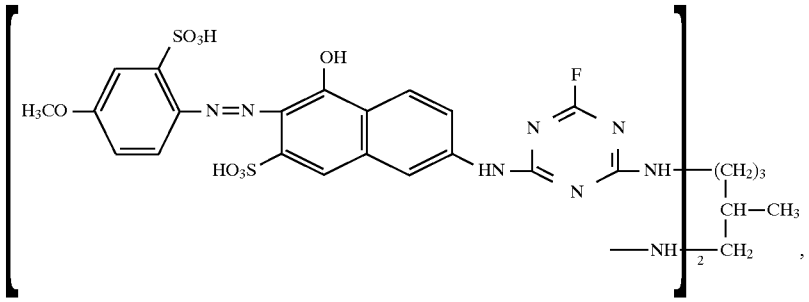

(9)

1 g/l of the dye of formula

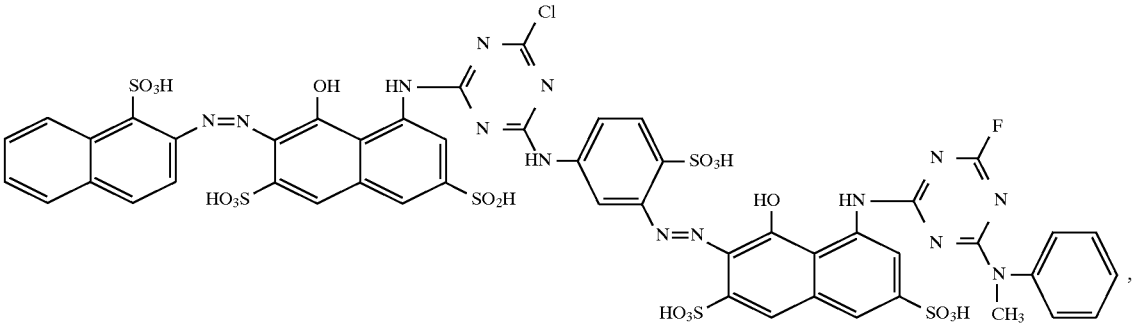

(10)

3 g/l of the dye of formula (7) given in Example 13,

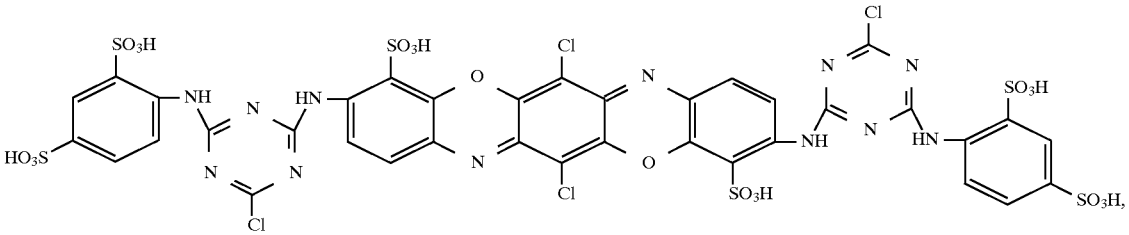

(11)

70 g/l of dimethyloldihydroxyethylene urea crosslinking agent of formula

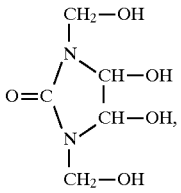

70 g/l of choline (compound according to example 1),
30 g/l of polyethylene emulsion (fabric softener, e.g. Turpex® ACN),
0.8 g/l of acetic acid,
18 g/l of magnesium chloride hexahydrate.

The padded fabric is dried for c. 2 minutes at 130° C. and then thermofixed for c. 5 minutes at 155° C., giving, without any further rinsing or washing whatsoever, a brown trichromatic dyeing having good allround fastness properties and, in particular, good fastness to wet treatments.

EXAMPLE 15

The general procedure of Example 14 is repeated, but replacing 3 g/l of the dye of formula (7) with 5 g/l of the dye of formula to give a trichromatic dyeing having comparably good fastness properties.

EXAMPLE 16

A cotton satin fabric is impregnated on a pad to a pinch-off effect of c. 70% liquor pick-up with a padding liquor of the following composition:

5 g/l of the dye of formula (8) given in Example 14, 4 g/l of the dye of formula (9) given in Example 14, 1 g/l of the dye of formula (10) given in Example 14, 3 g/l of the dye of formula (7) given in Example 13, 55 g/l of the melamine/resin mixture containing the compounds of formula

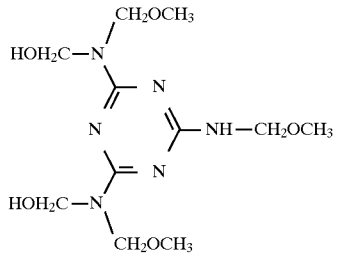

(60% aqueous solution)

and

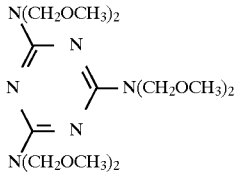

in the ratio of 1:3, 100 g/l of choline (compound according to example 1),
30 g/l of polyethylene emulsion (fabric softener, e.g. Turpex® ACN),
0.8 g/l of acetic acid,
2 g/l of ammonium chloride.

The padded fabric is dried for c. 2 minutes at 130° C. and then thermofixed for c. 5 minutes at 155° C. The dyeing so obtained is rinsed cold and hot, soaped twice at the boil with 2 g/l of $Na_2CO_3$ and 2 g/l of a nonionic surfactant, and then rinsed and dried, to give a brown trichromatic dyeing of very good tinctorial strength and having good allround fastness properties.

EXAMPLE 17

The general procedure of Example 16 is repeated, but replacing 3 g/l of the dye of formula (7) with 5 g/l of the dye of the formula (11) given in Example 15, to give a trichromatic dyeing having comparably good fastness properties.

What is claimed is:

1. A process for dyeing and finishing cellulosic textile fibre material in one step, which process comprises applying to said textile fibre material by pad dyeing methods a liquor comprising (A) at least one reactive dye suitable for dyeing cellulosic materials, (B) a crosslinking agent for improving creasing and shrinkage, wherein the crosslinking agent is a glyoxalurea derivative, a melamine/formaldehyde condensate which may be partially or completely etherified, or a N-methylolurea compound which may be partially or completely etherified, (C) a crosslinking catalyst for anticrease and antishrinking finish, wherein the crosslinking catalyst is an inorganic acid, a Lewis acid, an ammonium salt or the hydrohalide of an organic amine, and (D) choline and subsequently fixing the dye on the textile fibre material.

2. A process according to to claim 1, wherein component (B) is one or more than one melamine/formaldehyde condensate, which is partially or completely etherified, of formula

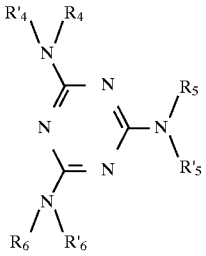

(4)

wherein $R_4$, $R'_4$, $R_5$, $R'_5$, $R_6$ and $R'_6$ are each independently of one another hydrogen, —$CH_2$—OH or —$CH_2$—$OCH_3$, and wherein at least one of $R_4$, $R'_4$, $R_5$, $R'_5$, $R_6$and $R'_6$ has a meaning other than hydrogen.

3. A process according to claim 1, wherein the crosslinking catalyst (C) is an ammonium salt or a magnesium-containing Lewis acid.

4. A process according to claim 1, wherein the component (D) is used in an amount of 5 to 200 g/l of dye liquor.

5. A process for dyeing and finishing cellulosic textile fibre material according to claim 1, which comprises applying to said textile fibre material a liquor comprising (A) at least one reactive dye, (B) a crosslinking agent selected from the group consisting of a glyoxalurea derivative, a melamine/formaldehyde condensate which may be partially or completely etherified and a N-methylolurea compound which may be partially or completely etherified, (C) a crosslinking catalyst selected from the group consisting of an inorganic acid, a Lewis acid, an ammonium salt and the hydrohalide of an organic amine, and (D) choline and subsequently fixing the dye on the textile fibre material.

6. A process according to claim 1, wherein the component (D) is used in an amount of 30 to 150 g/l of dye liquor.

7. An aqueous composition comprising (A) at least one reactive dye suitable for dyeing cellulosic materials, (B) a crosslinking agent for improving creasing and shrinkage, wherein the crosslinking agent is a glyoxalurea derivative, a melamine/formaldehyde condensate which may be partially or completely etherified, or a N-methylolurea compound which may be partially or completely etherified, (C) a crosslinking catalyst for anticrease and antishrinking finish, wherein the crosslinking catalyst is an inorganic acid, a Lewis acid, an ammonium salt or the hydrohalide of an organic amine, and (D) choline.

8. Method of use of an aqueous composition according to claim 7 for simultaneously dyeing and finishing cellulosic textile fibre materials.

* * * * *